US012729592B2

(12) United States Patent
Clark et al.

(10) Patent No.: US 12,729,592 B2
(45) Date of Patent: Sep. 8, 2026

(54) WELL CONTROL SYSTEM AND METHOD OF USE

(71) Applicant: DEEP BLUE OIL & GAS LIMITED, Aberdeen (GB)

(72) Inventors: Alan Clark, Aberdeen (GB); Alan Reid, Aberdeen (GB)

(73) Assignee: DEEP BLUE OIL & GAS LIMITED, Aberdeen (GB)

( * ) Notice: Subject to any disclaimer, the term of this patent is extended or adjusted under 35 U.S.C. 154(b) by 0 days.

(21) Appl. No.: 17/771,540

(22) PCT Filed: Oct. 23, 2020

(86) PCT No.: PCT/GB2020/052704
§ 371 (c)(1),
(2) Date: Apr. 25, 2022

(87) PCT Pub. No.: WO2021/079156
PCT Pub. Date: Apr. 29, 2021

(65) Prior Publication Data

US 2022/0403709 A1 Dec. 22, 2022

(30) Foreign Application Priority Data

Oct. 25, 2019 (GB) ..... 1915534

(51) Int. Cl.

| | |
|---|---|
| ***E21B 21/08*** | (2006.01) |
| ***E21B 17/08*** | (2006.01) |
| ***E21B 33/08*** | (2006.01) |
| *E21B 19/00* | (2006.01) |

(52) U.S. Cl.
CPC ..... *E21B 21/08* (2013.01); *E21B 17/0853* (2020.05); *E21B 33/085* (2013.01); *E21B 19/006* (2013.01)

(58) Field of Classification Search
CPC ..... E21B 21/08; E21B 21/085; E21B 17/0853
See application file for complete search history.

(56) References Cited

U.S. PATENT DOCUMENTS

| | | | | |
|---|---|---|---|---|
| 8,408,074 | B2 | 4/2013 | Dietz | |
| 10,883,357 | B1 * | 1/2021 | Orbell | E21B 47/06 |
| 11,035,192 | B1 * | 6/2021 | Gabaldon | E21B 33/0355 |
| 2013/0192841 | A1 * | 8/2013 | Feasey | E21B 21/001 166/336 |
| 2016/0076323 | A1 * | 3/2016 | Fraczek | E21B 33/076 166/367 |

(Continued)

FOREIGN PATENT DOCUMENTS

| | | | |
|---|---|---|---|
| WO | WO 2000/75477 | A1 | 12/2000 |
| WO | WO 2016/044834 | A1 | 3/2016 |

(Continued)

OTHER PUBLICATIONS

International Search Report dated Jan. 14, 2021 for PCT/GB2020/052704.

*Primary Examiner* — Giovanna Wright
(74) *Attorney, Agent, or Firm* — Osha Bergman Watanabe & Burton LLP

(57) ABSTRACT

The invention provides well control system for a riser. The well control system comprises a riser assembly and at least one flow meter. The at least one flow meter is configured to be mounted on the riser.

27 Claims, 11 Drawing Sheets

(56) References Cited

U.S. PATENT DOCUMENTS

| | | | | |
|---|---|---|---|---|
| 2016/0138351 | A1* | 5/2016 | Dillard | E21B 21/106<br>175/25 |
| 2019/0055791 | A1* | 2/2019 | Barela | E21B 23/02 |
| 2019/0195032 | A1* | 6/2019 | Clark | E21B 19/006 |

FOREIGN PATENT DOCUMENTS

| | | | | |
|---|---|---|---|---|
| WO | WO 2017/112532 | A1 | 6/2017 | |
| WO | WO-2018042186 | A1 * | 3/2018 | E21B 17/01 |
| WO | WO 2018/231729 | A1 | 12/2018 | |

* cited by examiner

WELL CONTROL SYSTEM AND METHOD OF USE

This application is the U.S. National Stage of International Application No. PCT/GB2020/052704, which was filed on Oct. 23, 2020. This application also claims the benefit of the filing date of GB patent application No. 1915534.0 which was filed on Oct. 25, 2019. The contents of both of these applications are hereby incorporated by reference.

The present invention relates to drilling well control systems and method of use, and in particular to managed pressure drilling for subsea applications. A particular aspect of the invention relates to converting existing drilling systems to enable managed pressure drilling operations.

BACKGROUND TO THE INVENTION

Drilling operations typically use a rotating drill bit on the end of a drill string. Mud is pumped down the drill string from a rig mud pumping system and returned to the surface flowing in the annulus between the drill string and the well. The returning mud exits the annulus above a blow-out preventer (BOP) into a mud return line where it freely flows into solids control equipment to allow sand and cuttings to be removed from the well. The mud is stored in holding tanks until it is pumped back down the well.

The mud which is pumped down the drill string performs multiple functions, including providing hydraulic power to drilling tools at the end of the drill string, stabilising the well, and cooling the drill bit. The mud provides pressure in the well which prevents an influx of pressurised gas or oil from any hydrocarbon bearing formations. The pressure is a function of the mud density, friction in the wellbore caused by the flowing mud, and the vertical depth of the well. The density of the mud must be controlled to provide a pressure at the bottom of the well which is above the pore pressure (the pressure at which the well may collapse or allow a hydrocarbon influx) but below the fracture pressure (the pressure where the well structure could fracture).

Managed Pressure Drilling (MPD) is a form of drilling where the pressure at the bottom of the well is more precisely controlled using various methods apart from controlling the mud density. MPD is used to drill wells in conditions where the local geology makes conventional drilling difficult or impossible.

For MPD operations the mud circulation system becomes a closed loop with returning mud from the wellbore flowing into an arrangement of valves or manifolds that can apply backpressure or route the flow to other processing systems. The annulus is capped above the BOP using a seal, typically a rotating control device (RCD).

Offshore drilling relies on the use of a tubular, known as a drilling riser, which allows the annulus to extend from the seabed to the surface. For floating drilling vessels, a riser section known as a slip joint or telescopic joint is used to allow the free movement of the drilling vessel caused by wave motion.

Managed pressure drilling systems are known which utilise a managed pressure drilling manifold comprising metering, distribution and choke manifolds mounted on a skip on the rig at surface. However, these manifolds are bulky and take up considerable space on a rig or drill ship. The manifolds also require numerous hoses and control lines to be run from the riser to the manifold.

SUMMARY OF THE INVENTION

It is an object of an aspect of the present invention to obviate or at least mitigate the foregoing disadvantages of prior art well control and managed pressure drilling systems.

It is another object of an aspect of the present invention to provide a robust, reliable and compact well control system suitable for deployment on riser assemblies used in a variety of drilling.

It is a further object of an aspect of the present invention to provide marine risers with a managed pressure drilling system with improved reliability and accessibility.

It is another object of an aspect of the present invention to provide a marine riser conversion system for managed pressure drilling operations.

Further aims of the invention will become apparent from the following description.

According to a first aspect of the invention there is provided a well control system for a riser comprising:

a riser assembly; and at least one flow meter;

wherein the at least one flow meter is configured to be mounted on the riser.

The at least one flow meter may be configured to be mounted on or located on an outer surface of the riser above or below a tension ring.

The at least one flow meter may be a differential pressure flow meter. The at least one flow meter may be selected from the group comprising orifice plate, wedge, venturi, Coriolis, Pitot tubes and/or variable area flow meters.

The system may comprise a control unit. The control unit may be configured to receive at least one measurement signal from the at least one flow meter and analyse the measurement signal in the control unit to monitor drilling fluid flow in the riser and/or in a least one mud return line.

The control unit may be configured to analyse the measurement signal to monitor at least one parameter or at least one property of the drilling fluid or drilling fluid flow in the riser and/or in a least one mud return line.

The control unit may determine or calculate a Reynolds number for the drilling fluid flow. The control unit may be configured to correct the Reynolds number as the properties of the drilling fluid change. The properties of the fluid change may change due to contaminates from debris, hydrocarbons, cuttings, sand, water etc.

The control unit may be configured to compare the at least one parameter with a desired range of operating parameters. The control unit may be configured to generate a control signal when the at least one parameter is determined to be outside of the desired range of operating parameters.

The control unit may be configured to calculate, estimate or predict the density and/or viscosity of the flowing drill fluid. The control unit may be configured for gas determination.

The at least one flow meter may have a flow measurement range of 10 to 2000 USG/min. The system may comprise two or more flow meters. Each flow meter may have different fluid flow range and/or fluid density range.

Preferably the system has two or more flow meters. The two or more meters may be arranged in series or parallel. The two or more meters may be mounted in a meter manifold. A first flow meter may have a flow measurement range of 10 to 400 USG/min. A second flow meter may have a flow measurement range of 100 to 2000 USG/min.

The internal diameters of the flow meters may be selected to determine a flow measurement range. A 2 inch diameter may be selected to have a flow measurement range of 10 to 400 USG/min. A 5 inch diameter may be selected for a flow measurement range of 100 to 2000 USG/min.

Preferably the riser assembly comprises a riser isolation device. The at least one flow meter may be mounted in at least one meter manifold. The riser isolation device and/or the at least one flow meter manifold may be located on a riser above a riser tension ring. The riser isolation device and/or at least one flow meter manifold may be located on a riser below a riser tension ring.

The riser assembly may comprise at least one choke assembly. The at least one choke assembly may be mounted on the riser. The at least one choke assembly may be a choke manifold. The at least one choke assembly may be located on a riser above or below a riser tension ring. The at least one choke assembly may be mounted on or located on the outer surface of a riser above or below a riser tension ring.

The riser assembly may comprise a rotating control device. The rotating control device may be located on a riser above or below a riser tension ring.

The at least one choke assembly and/or at least one flow meter assembly may form part of a managed pressure drilling manifold. The managed pressure drilling manifold may be mounted on the riser. The managed pressure drilling manifold may be mounted on or located on the outer surface of a riser above or below a riser tension ring.

The at least one flow meter may be integrated with a flow spool and/or the at least one choke assembly. The riser assembly may comprise an integrated flow spool, choke manifold and/or flow meter manifold on a riser joint or a riser slip joint. The riser slip joint may be a retrievable riser slip joint. The riser assembly may comprise an upper riser disconnect assembly. The upper riser disconnect assembly may be located above the riser tension ring.

The riser isolation device, at least one flow meter, at least one choke assembly, rotating control device and/or the managed pressure drilling manifold may be located on a riser and/or slip joint above the upper riser disconnect assembly.

By providing at least flow meter on the riser allows improved well control as properties of the drilling fluid and returns can be accurately measured and/or monitored. It also provides improved hose management as hoses and control lines are not required to be run from the riser to flow meters located at surface. Providing a flow meter directly on the riser also avoids locating bulky metering manifolds on the rig.

By providing components of a riser assembly above an upper riser disconnect assembly above the tension ring may enable the components to be installed, removed or replaced easily.

The upper riser assembly comprising slip joint, at least one flow meter, at least one choke assembly, rotating control device and/or the managed pressure drilling manifold may be installed on the riser and the RCD and/or other MPD equipment kept offline during conventional drilling and only brought online for a required MPD operation.

The at least one choke assembly may receive drilling fluid from the riser annulus below the RCD. The at least one choke assembly may be an MPD choke.

The upper riser disconnect assembly, riser isolation device, at least one flow meter, at least one choke assembly, rotating control device and/or the managed pressure drilling manifold may be controlled remotely.

The at least one flow meter may be an in-line flow meter. The at least one flow meter may be configured to be connected to a distribution assembly comprising at least one valve assembly. The distribution assembly may be located on the riser. The at least one flow meter and/or the distribution assembly may be connected to the at least one choke assembly mounted on the riser. The distribution assembly may comprise at least one spool or hose connecting the at least one flow meter and/or the at least one choke assembly.

The at least one valve assembly on the riser may be configured to open a pathway between the riser annulus and the distribution assembly, at least one flow meter and/or at least one choke assembly.

The tension ring may be disposed circumferentially about a portion of the riser, a portion of the RID, a portion of slip joint, an outer barrel of a slip joint, a portion of the upper riser disconnect assembly and/or a tension joint.

The upper riser disconnect assembly may comprise an upper connector and a lower connector. The upper and lower connectors may be configured to disconnect from one another. The separated upper and lower connectors may be configured to connect to one another.

The slip joint may be a two-part slip joint. Alternatively, the slip joint may be a three or more part slip joint. The slip joint may comprise at least one sealing assembly. The slip joint may be a telescopic joint. The slip joint may comprise two telescopic members. The slip joint may comprise more than two telescopic members.

According to a second aspect of the invention there is provided a riser assembly comprising:

a riser; and a managed pressure drilling manifold mounted on the riser.

The managed pressure drilling manifold may comprise at least one flow meter module, at least one choke module and/or at least one valve assembly.

The managed pressure drilling manifold may comprise an integrated flow spool, choke manifold and/or metering manifold. The managed pressure drilling manifold may be mounted on a retrievable riser slip joint.

The least one flow meter module may comprise at least one flow meter. The at least one flow meter may be an inline flow meter. The at least one flow meter may be configured to be connected to a distribution assembly comprising at least one valve assembly. The distribution assembly may be located on the riser. The at least one flow meter and/or the distribution assembly may be connected to the at least one choke assembly mounted on the riser. The distribution assembly may comprise at least one spool or hose connecting the at least one flow meter and/or the at least one choke assembly.

The at least one valve assembly on the riser may be configured to open a pathway between the riser annulus and the distribution assembly, at least one flow meter and/or at least one choke assembly.

The riser assembly may be connected to or installed onto a riser system to allow a managed pressure drilling operation without requiring structural modifications to riser. The upper riser assembly comprising a riser isolation device and a managed pressure drilling manifold may be connected to the upper riser disconnect assembly located above the tension ring.

Embodiments of the second aspect of the invention may include one or more features of the first aspect of the invention or its embodiments, or vice versa.

According to a third aspect of the invention there is provided a system for well control comprising:

an upper riser assembly comprising an upper riser disconnect assembly; and at least one flow meter assembly, wherein the at least one flow meter assembly is mounted on the upper riser assembly.

The at least one flow meter assembly may be mounted on an outer surface of the upper riser assembly. The upper riser assembly may comprise a riser isolation device. The upper riser assembly may comprise a slip joint. The at least one flow meter assembly may be mounted on an outer surface of the slip joint.

The slip joint and/or the riser isolation device may be mounted to the upper riser disconnect assembly above the upper riser disconnect assembly.

The upper riser assembly may be connectable to a lower riser. The upper riser assembly may be connected to a lower riser by connecting the upper riser disconnect assembly to the riser. The upper riser assembly may be connected to a riser above a riser tension ring.

The system may comprise at least one choke assembly. The at least one choke assembly may be mounted on the upper riser assembly. The at least one choke assembly may be mounted on the slip joint. The upper riser assembly may be a self-contained well control system.

The at least one flow meter and/or at least one choke assembly may be integrated with a flow spool. The integrated at least one flow meter, at least one choke assembly and integrated flow spool system may be mounted on a retrievable slip joint.

The riser assembly may comprise a rotating control device. The rotating control device may be located in the system between the slip joint and the RID.

The at least one choke assembly and/or at least one flow meter assembly may form part of a managed pressure drilling manifold. The managed pressure drilling manifold may be mounted on the upper riser assembly and/or slip joint.

Embodiments of the third aspect of the invention may include one or more features of the first or second aspects of the invention or its embodiments, or vice versa.

According to a fourth aspect of the invention there is provided a system for managed pressure drilling in a riser comprising:

an upper riser assembly comprising:

an upper riser disconnect assembly;

a rotating control device; and at least one flow meter assembly, wherein the at least one flow meter assembly is mounted on the upper riser assembly.

The upper riser assembly may comprise a slip joint. The upper riser assembly may comprise riser isolation device. The riser isolation device may be mounted to the upper riser disconnect assembly above the upper riser disconnect assembly.

The upper riser assembly may be connectable to a lower riser. The upper riser assembly may be connected to a lower riser by connecting the upper riser disconnect assembly to a riser. The upper riser assembly may be connected to a riser above a riser tension ring.

The system may comprise at least one choke assembly. The at least one choke assembly may be mounted on the upper riser assembly. The at least one choke assembly may be mounted on the slip joint.

The at least one choke assembly and/or at least one flow meter assembly may form part of a managed pressure drilling manifold. The managed pressure drilling manifold may be mounted on the upper riser assembly and/or slip joint.

The upper riser assembly and/or the slip joint may comprise a self-contained well control system. The self-contained well control system may comprise at least one flow meter, at least one choke assembly and/or an integrated flow spool.

The riser isolation device, at least one flow meter, at least one choke assembly, rotating control device and/or the managed pressure drilling manifold may be located above the upper riser disconnect assembly.

Providing at least flow meter and/or at least one choke assembly and RCD on the upper riser assembly avoids the requirement for surface MPD flow meter and choke manifolds.

The at least one flow meter assembly may form part of a managed pressure drilling manifold. The managed pressure drilling manifold may comprise at least one flow meter module, at least one choke module and/or at least one valve assembly. The at least one flow meter module, at least one choke module and/or at least one valve assembly are mounted on the upper riser assembly.

The at least one flow meter assembly, valve manifold and/or at least one valve may be mounted on an outer surface of the slip joint on the upper riser assembly.

Embodiments of the fourth aspect of the invention may include one or more features of the first, second or third aspects of the invention or their embodiments, or vice versa.

According to a fifth aspect of the invention there is provided a system for managed pressure drilling in a riser comprising:

a riser assembly comprising a rotating control device; and at least one flow meter assembly, wherein the at least one flow meter assembly is mounted on the riser.

The riser assembly may comprise a slip joint. The at least one flow meter may be mounted on the slip joint. The riser assembly may comprise riser isolation device. The riser may comprise an upper riser disconnect assembly. The slip joint may be a retrievable slip joint.

The system may comprise at least one choke assembly. The at least one choke assembly may be mounted on the riser. The at least one choke assembly may be mounted on the slip joint.

The system may comprise an integrated flow spool, choke manifold and/or metering manifold on the slip joint.

The at least one choke assembly and/or at least one flow meter assembly may form part of a managed pressure drilling manifold. The managed pressure drilling manifold may be mounted on the upper riser assembly and/or slip joint.

The at least one flow meter assembly, valve manifold and/or at least one valve may be mounted on an outer surface of the slip joint on the riser.

The riser isolation device, rotating control device and/or the managed pressure drilling manifold may be located on a riser above a riser tension ring.

The upper riser disconnect assembly may be configured to be connected to a tension joint above the tension ring.

Preferably the upper riser assembly which comprise the riser isolation device, rotating control device and the managed pressure drilling manifold may be releasably connected to the lower riser assembly via the upper riser disconnect assembly.

Embodiments of the fifth aspect of the invention may include one or more features of the first to fourth aspects of the invention or their embodiments, or vice versa.

According to a sixth aspect of the invention there is provided a metering manifold for use on a riser comprising:

at least one flow meter;

wherein the metering manifold is mountable on the riser.

The metering manifold may be mountable on the slip joint. The metering manifold may be connected to at least one choke assembly which is mountable on the riser and/or slip joint.

The metering manifold may be connected to at least one flow spool. The metering manifold, at least one choke assembly and at least one flow spool may be an integrated unit. The integrated unit mountable on the riser and/or slip joint.

Embodiments of the sixth aspect of the invention may include one or more features of the first to fifth aspects of the invention or their embodiments, or vice versa.

According to a seventh aspect of the invention there is provided a managed pressure manifold for managed pressure drilling comprising:

at least one flow meter;

wherein the managed pressure manifold is mounted on the riser.

The managed pressure manifold may comprise at least one choke assembly. The managed pressure manifold may comprise least one flow spool. The at least one choke assembly, at least one flow meter and at least one flow spool may be an integrated unit.

The managed pressure manifold may be mounted on the slip joint. The integrated flow spool, choke assembly and flow meter manifold may be mounted on a slip joint.

Embodiments of the seventh aspect of the invention may include one or more features of the first to sixth aspects of the invention or their embodiments, or vice versa.

According to an eighth aspect of the invention there is provided a method of installing a riser well control system in a subsea riser comprising:

providing a riser assembly and installing at least one flow meter assembly on the riser.

The method may comprise installing at least one choke assembly on the riser.

The method may comprise installing a riser isolation device above a tension ring on the riser. The method may comprise installing a riser isolation device on the riser string above the tension ring.

The method may comprise providing a valve assembly and/or a distribution assembly.

The method may comprise making up a tension ring. The method may comprise connecting the tension ring to the riser, riser isolation device, slip joint and/or the upper riser disconnect assembly.

The method may comprise mounting the at least one flow meter assembly and the at least one choke assembly on at least one component of the upper riser assembly. The method may comprise installing the upper riser assembly with connected at least one flow meter assembly and/or at least one choke assembly on the riser.

The method may comprise mounting the at least one flow meter assembly and the at least one choke assembly on the slip joint.

The method may comprise installing the upper riser disconnect assembly on the riser string above the tension ring.

Embodiments of the eighth aspect of the invention may include one or more features of the first to seventh aspects of the invention or their embodiments, or vice versa.

According to a ninth aspect of the invention there is provided a method of installing a managed pressure drilling system on a subsea riser comprising:

providing a riser assembly;

installing a rotary control device; and installing at least one flow meter assembly on the riser.

The method may comprise installing an upper riser disconnect assembly above the tension ring. The method may comprise installing the rotary control device and the at least one flow meter assembly above the upper riser disconnect assembly.

The method may comprise installing a riser isolation device above the tension ring.

The method may comprise installing at least one a choke assembly, at least one valve assembly and/or a distribution assembly. The method may comprise installing an integrated at least one flow meter, at least one a choke assembly and a flow spool on the riser or slip joint. The method may comprise making up the tension ring. The method may comprise connecting the tension ring to the riser below the upper riser disconnect assembly.

The method may comprise installing the upper riser disconnect assembly on the riser string and then installing the rotary control device onto the upper riser disconnect assembly.

The upper riser assembly including slip joint, managed pressure drilling manifold, RCD and RID may be installed on the lower riser by releasably latching onto the upper riser disconnect assembly.

Embodiments of the ninth aspect of the invention may include one or more features of the first to eighth aspects of the invention or their embodiments, or vice versa.

According to a tenth aspect of the invention there is provided a method of converting a marine riser for well control operations comprising:

providing a riser assembly and installing at least one flow meter assembly on the riser.

The method may comprise installing at least one choke assembly on the riser. The method may comprise installing an upper riser assembly on the riser with the at least one flow meter assembly and/or the at least one choke assembly mounted on upper riser assembly.

The method may comprise installing a slip joint on the riser with the at least one flow meter assembly, the at least one choke assembly and/or an integrated flow spool mounted on the outer surface of the slip joint. The method may comprise removing an existing slip joint and/or an existing slip joint inner barrel on the subsea riser.

Embodiments of the tenth aspect of the invention may include one or more features of the first to ninth aspects of the invention or their embodiments, or vice versa.

According to an eleventh aspect of the invention there is provided a method of converting a marine riser for MPD operations which enables managed pressure subsea drilling operations comprising:

installing a rotary control device; and at least one flow meter assembly on the riser.

The method may comprise installing at least one choke assembly on the riser and/or the slip joint.

The method may comprise installing at least one choke assembly on the riser. The method may comprise installing an upper riser assembly on the riser with the at least one flow meter assembly and/or the at least one choke assembly mounted on upper riser assembly.

The method may comprise installing a slip joint on the riser with the at least one flow meter assembly, the at least one choke assembly and/or an integrated flow spool mounted on the outer surface of the slip joint.

The method may comprise removing an existing slip joint and/or an existing slip joint inner barrel on the subsea riser.

Embodiments of the eleventh aspect of the invention may include one or more features of any of the first to tenth aspects of the invention or their embodiments, or vice versa.

According to a twelfth aspect of the invention there is provided a method of measuring at least one parameter or property of drill fluid in subsea riser comprising:

providing a riser assembly comprising:

at least one flow meter assembly;

wherein the at least one flow meter assembly is mounted on the riser;

measuring at least one parameter or at least one property of the drill fluid in the riser.

The method may comprise generating a measurement signal to a control unit. The method may comprise analysing the measurement signal in the control unit to compare the at least one parameter with a desired range of operating parameters.

The method may comprise generating a control signal from the control unit when the at least one parameter is determined to be outside of the desired range of operating parameters.

The method may comprise analysing the measurement signal in the control unit to monitor drilling fluid flow in the riser and/or in a least one mud return line.

The method may comprise monitoring at least one parameter or at least one property of the drilling fluid or drilling fluid flow in the riser and/or in a least one mud return line.

The at least one flow meter may be a differential pressure flow meter.

The method may comprise measuring a pressure differential across a differential pressure flow meter $\Delta P$. The method may comprise measuring a line pressure drop due to friction APf along a length L of pipe.

The method may comprise and calculating the quantity $APf/\Delta P$ and thereby calculating one or more properties of the flow of drilling fluid.

The method may comprise determining or calculating a friction factor. The method may comprise calculating the discharge coefficient of the flow, Reynolds number, density, viscosity and/or flow rate of the drilling fluid.

The method may comprise calculating an operational corrected value of the calculated Reynolds number. The method may comprise calculating the discharge coefficient from the Reynolds number, where the Reynolds number is determined from the calculated friction factor.

The method may comprises determining or calculating a Reynolds number for the drilling fluid flow. The method may comprise taking further measurements to monitor a change in the drilling fluid. The method may comprise correcting the correcting Reynolds number as the properties of the fluid changes. The method may comprise correcting the correcting Reynolds number based on the least further measurements taken.

The method may comprise comparing the at least one parameter with a desired range of operating parameters.

The method may comprise calculating, estimating or predicting the density and/or viscosity of the flowing drill fluid.

The method may comprise measuring at least one parameter or at least one property of the fluid using two or more flow meters. The method may comprise switching between a first flow meter having a first flow measurement range to a second flow meter having a second flow measurement range.

The method may comprise using knowledge of the geometry of the riser, geometry of the at least one flow meter, geometry of pipes or tubing, previous knowledge discharge coefficient as function of friction factor and/or Reynolds number to calculate or estimate information on the drilling fluid. The method may include estimating or calculating the friction factor, Reynolds number, Discharge coefficient, density, viscosity and corrected flowrate.

Embodiments of the twelfth aspect of the invention may include one or more features of any of the first to eleventh aspects of the invention or their embodiments, or vice versa.

According to a thirteenth aspect of the invention there is provided a method of measuring a property of the drill fluid in a subsea drilling operation comprising:

providing a riser assembly comprising;

a riser isolation device;

a rotary control device;

at least one flow meter mounted on the riser; and diverting drill fluid from the riser to the at least one flow meter.

The method may comprise diverting drill fluid from the riser beneath the rotary control device. The method may comprise diverting, measuring and/or choking drilling fluid returns from the riser beneath the rotary control device back into the riser via the at least one flow meter.

The method may comprise utilising existing mud return system. The method may comprise using the existing divert system and flow lines to reach the shakers.

Embodiments of the thirteenth aspect of the invention may include one or more features of any of the first to twelfth aspects of the invention or their embodiments, or vice versa.

According to a fourteenth aspect of the invention there is provided a method of managed pressure drilling in a subsea drilling operation comprising:

providing a riser assembly comprising;

a riser isolation device;

a rotary control device;

at least one flow meter mounted on the riser;

at least one choke assembly mounted on the riser;

measuring properties of the flow and actuating the choke to control flow.

The method may comprise diverting drill fluid from beneath the rotary control device. The method may comprise diverting, measuring and/or choking the drill fluid returns from the riser beneath the rotary control device and back into the riser (low pressure) via external low lines including the at least one flow meter and the at least one choke assembly.

The method may comprise utilising existing mud return system. The method may comprise using the existing divert system and flow lines to reach the shakers. The method may comprise diverting high pressure MPD returns from beneath the RCD back into the riser (low pressure) via flow lines including the at least one flow meter and at least one choke assemblies. The method may utilise existing mud return lines to shakers.

Embodiments of the fourteenth aspect of the invention may include one or more features of any of the first to thirteenth aspects of the invention or their embodiments, or vice versa.

According to a fifteenth aspect of the invention there is provided a method of measuring at least one parameter or property of drilling fluid in a subsea riser comprising:

providing a well control system for a riser comprising a riser assembly;

at least one flow meter;

wherein the at least one flow meter is located on an outer surface of the riser assembly above a riser tension ring; and measuring at least one parameter or at least one property of the drilling fluid in the riser.

Embodiments of the fifteenth aspect of the invention may include one or more features of any of the first to fourteenth aspects of the invention or their embodiments, or vice versa.

According to a sixteenth aspect of the invention there is provided method of managed pressure drilling in a subsea drilling operation comprising providing a well control system for a riser assembly comprising a riser assembly;

at least one flow meter;

wherein the at least one flow meter is located on an outer surface of the riser assembly above a riser tension ring; and providing a rotating control device; and measuring at least one property of drilling fluid flow using the at least one flow meter.

Embodiments of the sixteenth aspect of the invention may include one or more features of any of the first to fifteenth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
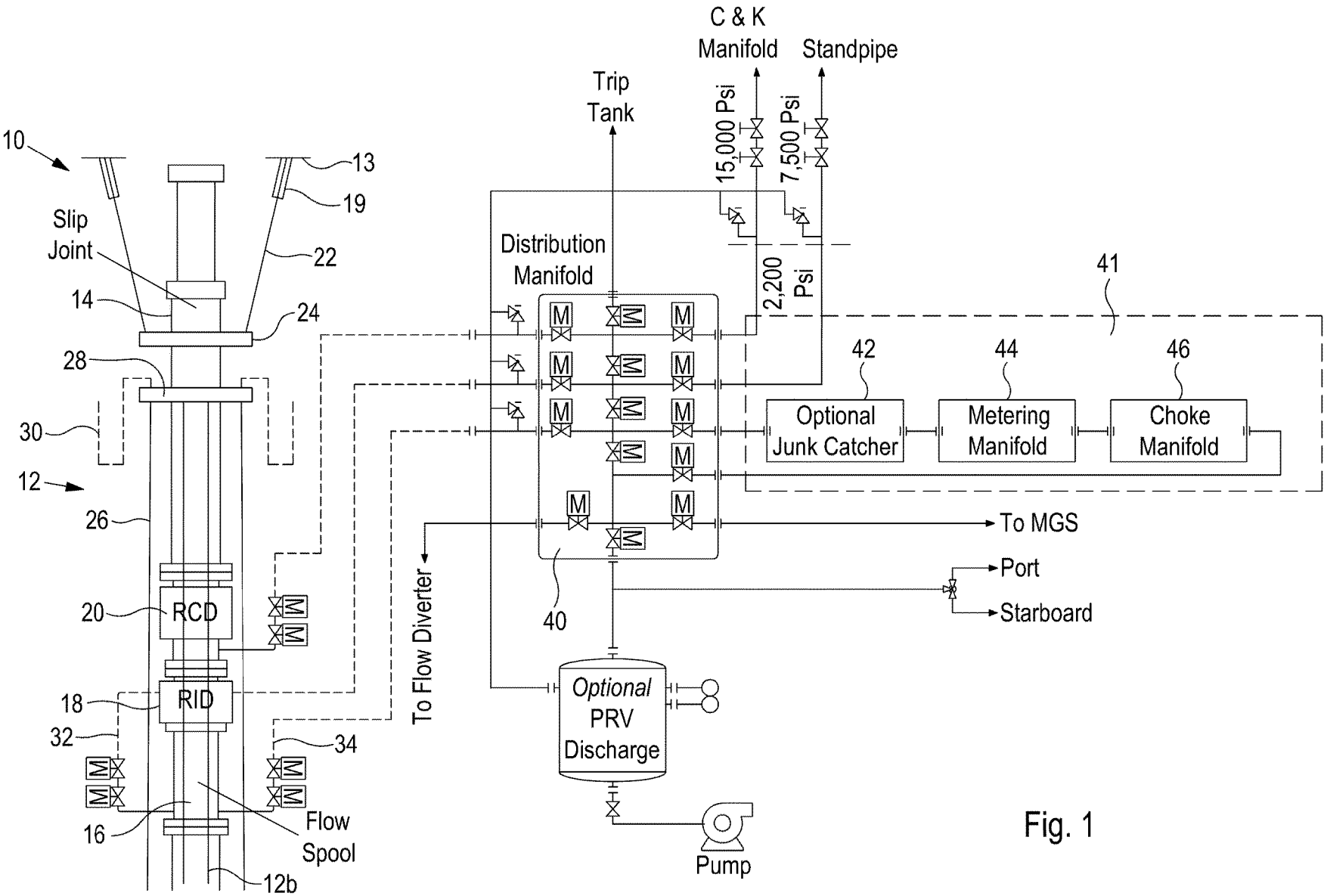
FIG. 1 is a representation of a managed pressure drilling (MPD) riser assembly according to the prior art.

FIG. 1 shows a schematic representation of a drilling system for managed pressure drilling of a subsea reservoir known in the prior art.

The drilling system 10 comprises a riser assembly 12 located between a rig platform 13 and a wellhead. The system 10 has a riser flow spool (RFS) 16, a riser isolation device (RID) 18, a rotating control device (RCD) 20 mounted on the riser.

The riser 12 is connected to a slip joint 14. The slip joint 14 is configured to respond to heave movement of the platform during dynamic sea conditions.

A portion of platform 13 is shown, which may be a floating rig or drillship. The platform supports the drilling system 10. A plurality of tensioning cylinders 19 are secured to the platform and exert an upward force on rods or cables 22. The lower end of each rod or cable 22 is connected to a riser tensioning ring 24 which is connected to maintain the stability of the drilling system 10 in the offshore environment.

External auxiliary lines 26 are connected to the BOP (not shown) and circulate fluids and provide control lines to the BOP. A termination ring 28 is disposed circumferentially about a portion of the slip joint 14. The auxiliary lines 26 terminate at the termination ring.

Flexible hoses 30 are connected to the termination ring 28 and extend upward coupling to the platform. The hoses 30 have been truncated in these drawings for clarity. The termination joint 28 provides fluid communication between the auxiliary lines 26 and the flexible hoses 30.

The RFS 16 has two drilling fluid return flowlines 32 and 34 in fluid communication with a distribution manifold 40 which directs flow to an MPD manifold 41 located at surface to allow applied drilling fluid back pressure.

The MPD manifold 41 includes a junk catcher 42 to catch and trap debris in the fluid, a metering manifold 44 to measure fluid flow rates and density and a choke manifold 46 to control for balanced and underbalanced fluid return rates and wellhead pressure during MPD operations.

Fluid returns are processed through a mud gas separator (MGS) or the rig's mud gas separator which separates the gas from the drilling fluid. The gas is vented to be burned or stored in a subterranean formation.

The fluid is then returned to the drill string in the riser assembly via a mud pump (not shown) to be recirculated in the drilling apparatus.

During a managed pressure drilling operation, the RCD 20 provides a rotating internal sealing element that seals against the drill string to create a pressure-tight barrier to establish a closed system and divert riser flow to the surface MPD manifold. The closed system enables dynamic adjustments to wellbore pressure, accurate flow rate measurement and safer mud gas separation. The metering manifold 44 measures the fluid flow rates and the choke manifold 46 enables control of the annular pressure by increasing or decreasing the annual flow.

Figure 2:
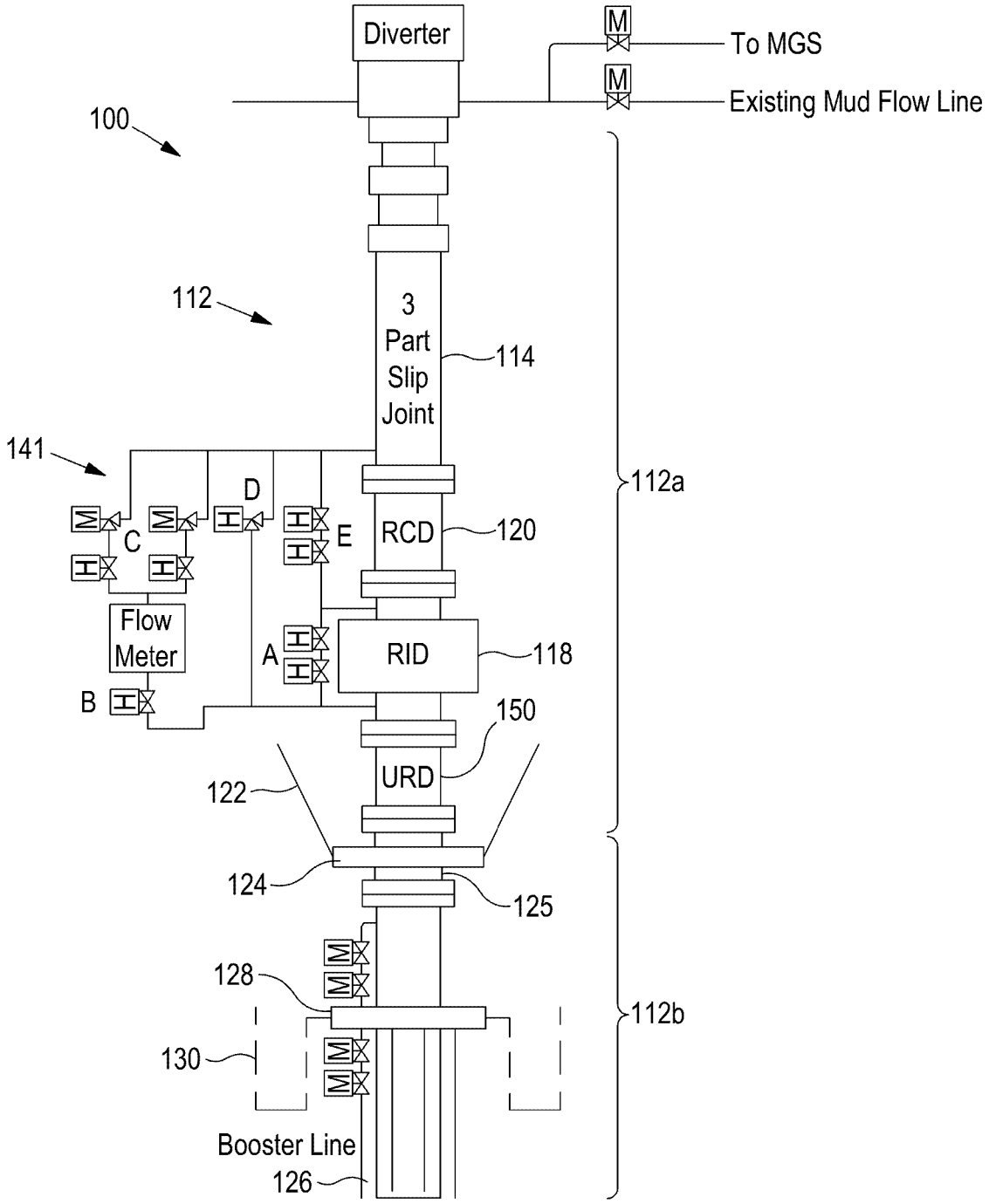
FIG. 2 is a schematic representation of a riser system for MPD according to a first embodiment of the invention.

FIG. 2 schematically shows features of a manage pressure drilling system 100 according to a first embodiment of the present invention. It will be appreciated that the drilling system can adopt different configurations depending on the type of riser system on which it is being installed and the type of drilling operation. FIG. 2 represents one possible configuration that the MPD system may adopt.

The drilling system 100 comprises a riser assembly 112. The system 100 has a riser isolation device (RID) 118, a rotating control device (RCD) 120 and an upper riser disconnect assembly (URD) 150 mounted on the riser below a slip joint 114. The slip joint 114 is configured to respond to heave movement of the platform during dynamic sea conditions.

The upper riser disconnect assembly 150 allows for a quick separation of the upper riser section 112*a* including RID, RCD and slip joint from the lower riser section 112*b*.

Tension ring 124 is disposed circumferentially about a tension joint 125 located between the quick disconnect assembly 150 and the lower riser section 112*b*. Although in this example the tension ring 124 is connected to tension joint 125, it may alternatively be connected to an existing rig outer barrel located between the quick disconnect assembly 150 and the riser 112. In this example the riser isolation device, a rotating control device 120 and an upper riser disconnect assembly 150 are disposed above the tension ring 124.

Tensioning cylinders are secured to the platform and exert an upward force on rods or cables 122. The lower end of each rod or cable 122 is connected to a riser tensioning ring 124 which is connected to maintain the stability of the riser string. For clarity the cables 122 are truncated and the platform has not been shown in FIG. 2.

In this example the slip joint is a telescopic three-part slip joint. However, it is appreciated that other types of slip joint may be used. The slip joint enables the riser system to adjust in length as the platform heaves in response to motion of the waves.

External auxiliary lines 126 are connected to the BOP (not shown) and circulate fluids and provide control lines to the BOP. A termination ring 128 is disposed circumferentially about a portion of the lower riser section 112*b*. The auxiliary lines 126 terminate at the termination ring 128. Flexible hoses 130 are connected to the termination ring 28 and extend upward coupling to the platform. The hoses 130 have been truncated in these drawings for clarity. The termination joint 128 provides fluid communication between the auxiliary lines 126 and the flexible hoses 130.

An MPD manifold system 141 is located on an outer surface of the riser string above the quick disconnect assembly 150 as best shown in FIGS. 3A to 3E. In this example the managed pressure manifold 141 is located on the outer surface of part of the slip joint 114. The MPD manifold system is a well control system.

MPD manifold system comprises flow lines 132 and 134. Flow line 132 comprises spool 162*a*, dual isolation valve 164*a*, an in-line flow meter 166*a*, choke 168*a* and return spool 170*a* into the riser bore. Flow line 132 comprise spool 162*b*, dual isolation valve 164*b*, an in-line flow meter 166*b* and choke 168*b* and return spool 170*b* into the riser bore.

During MPD, the MPD manifold system 141 routes drilling fluid from the riser bore beneath the RID and the RCD (High pressure upstream of RCD) in the MPD flow lines 132 and 134 respectively.

The MPD manifold system 141 includes in-line flow meters 166*a*, 166*b* and choke assemblies 168*a*, 168*b* in flow lines 132, 134 respectively which are mounted on the riser and connected to the riser bore below the RCD 120. The in-line flow meters 166*a*, 166*b* measure drilling fluid flow rates and density. The choke assemblies 168*a*, 168*b* enables control of the annular pressure by increasing or decreasing the annual flow. The MPD manifold system 141 diverts flow below the RCD 120, measures and chokes the MPD returns back into the riser via external MPD flow lines 132 and 134. This allows the fluid returns to utilise existing mud return systems in an upper riser section 112*a* including diverter system and flow lines to shakers.

The flow meter and choke assemblies are dimensioned such that they can be mounted on the slip joint without impacting the functioning of the slip joint.

Components of the MPD manifold system including the flow meters and choke assemblies are controlled remotely. The flow meters and choke assemblies may be controlled automatically by electronic or hydraulic monitoring equipment and/or slimline actuators.

The drilling fluid re-enters the riser bore at the bottom of the slip joint 114 and flows in the riser return system including the diverter.

Figure 3A:
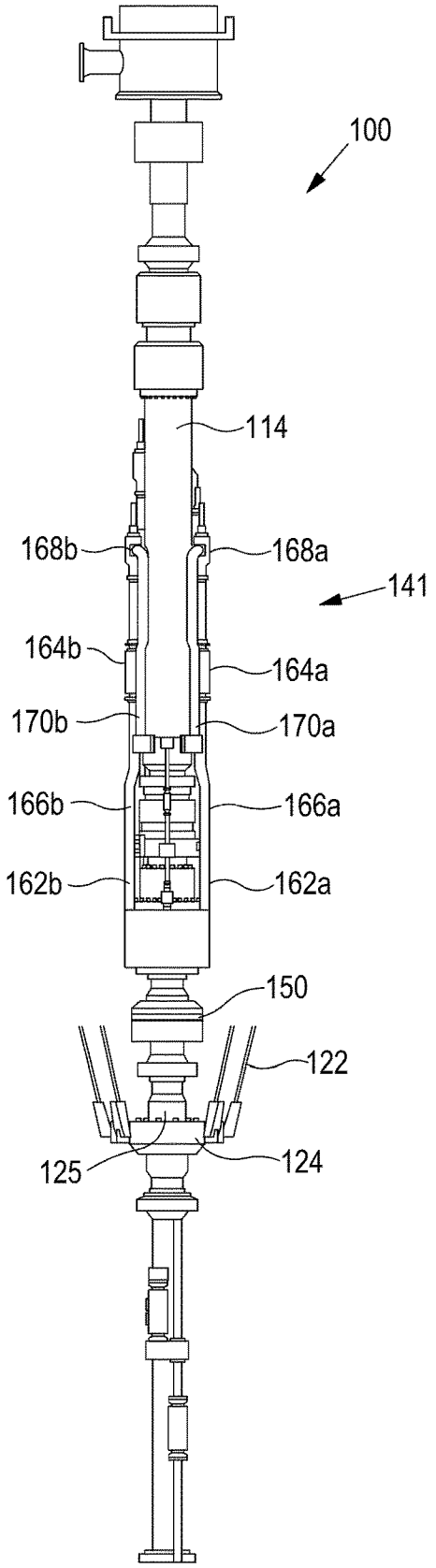
FIG. 3A to 3F are schematic representations of an upper riser assembly for the riser system shown in FIG. 2.
Figure 3B:
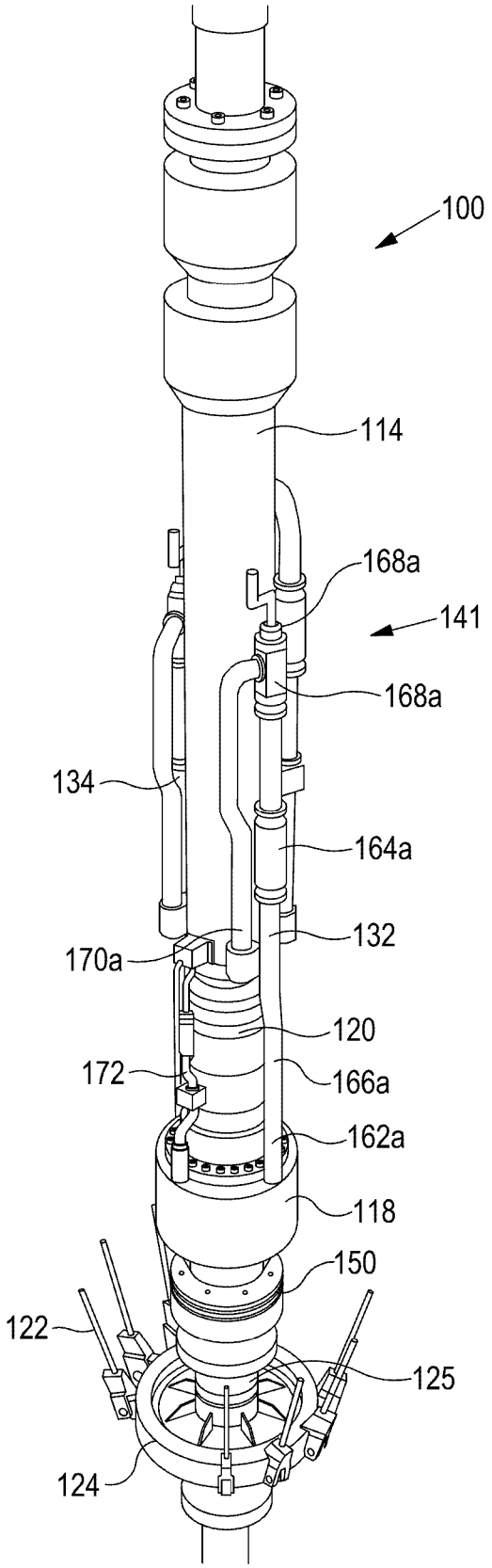
Figure 3C:
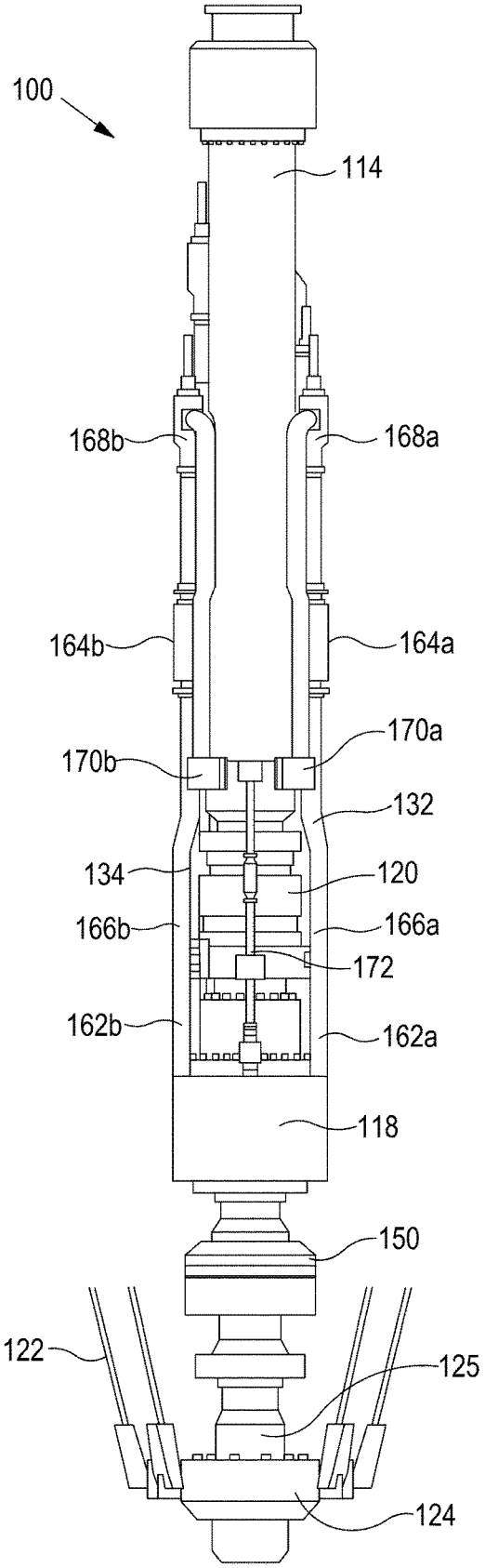
Figure 3D:
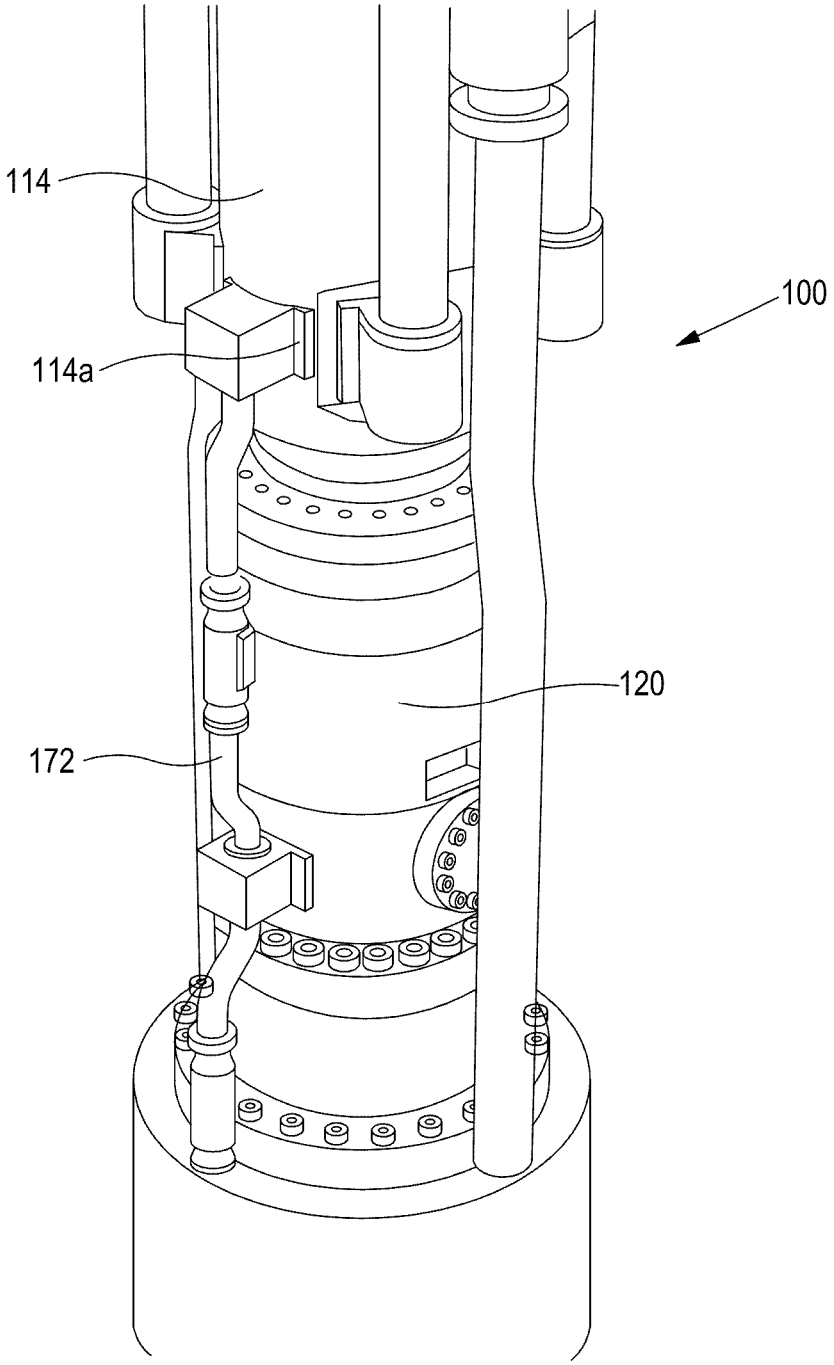
Figure 3E:
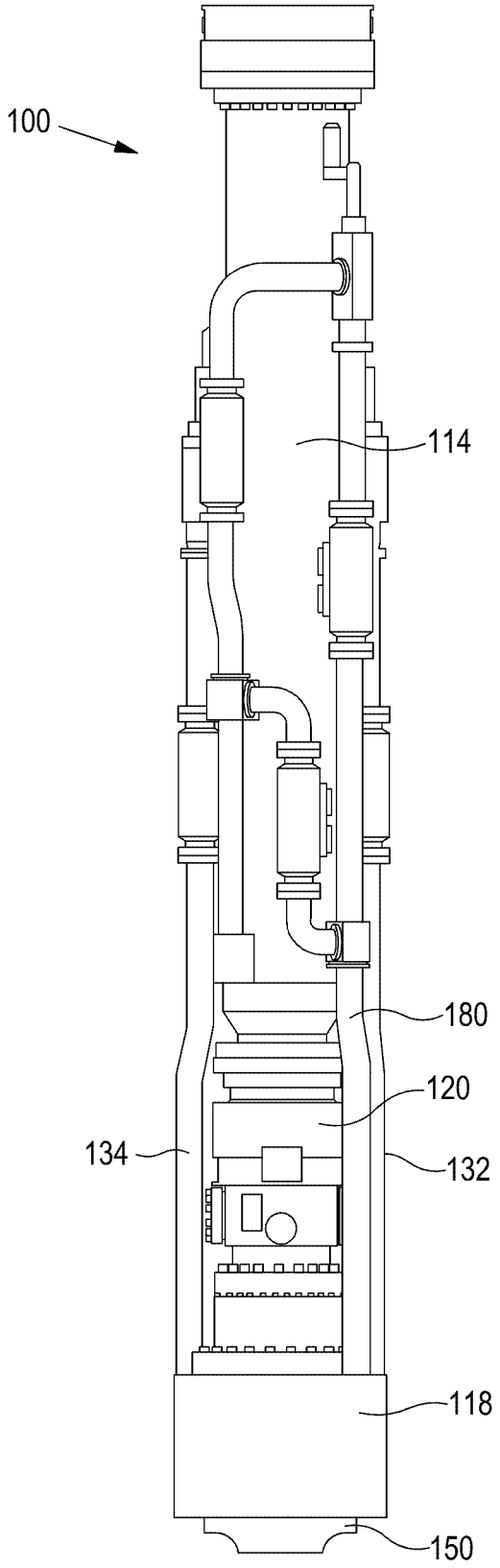

The MPD manifold system 141 has a third return flow line 180 with a bypass facility shown in FIG. 3E. The flow line 180 is safety system to operate as a riser over pressure protection (PRV) line with automated choke controls. This flow line enables the flow meter and choke assembly in flow lines 132 and 134 to be isolated and bypassed when not required such as when drilling out shoe.

During a managed pressure drilling operation, the RCD 20 provides a rotating internal sealing element that seals against the drill string to create a pressure-tight barrier to establish a closed system and divert riser flow to the surface MPD manifold. The closed system enables dynamic adjustments to wellbore pressure, accurate flowrate measurement and safer mud gas separation.

Fluid returns are processed through a mud gas separator (MGS) or the rigs mud gas separator which separates the gas from the drilling fluid. The gas is vented, flared, or stored in a subterranean formation. The fluid is then returned to the drill string via the mud pump to be recirculated in the drilling apparatus.

In the event of a gas kick the annular BOP (not shown) located on the lower riser is closed to seal around the drill string. The RID 118 is closed around the drill string to isolate the upper riser system and allow any gas in the riser to be contained.

Any isolated gas may be circulated through flowlines 132 and 134 via the choke manifold to maintain a back pressure in the riser allowing the gas to be circulated out in a controlled manor to the MGS to capture and separate large volume of free gas from the mud. The gas once separated from the mud is then safely vented.

Figure 3F:
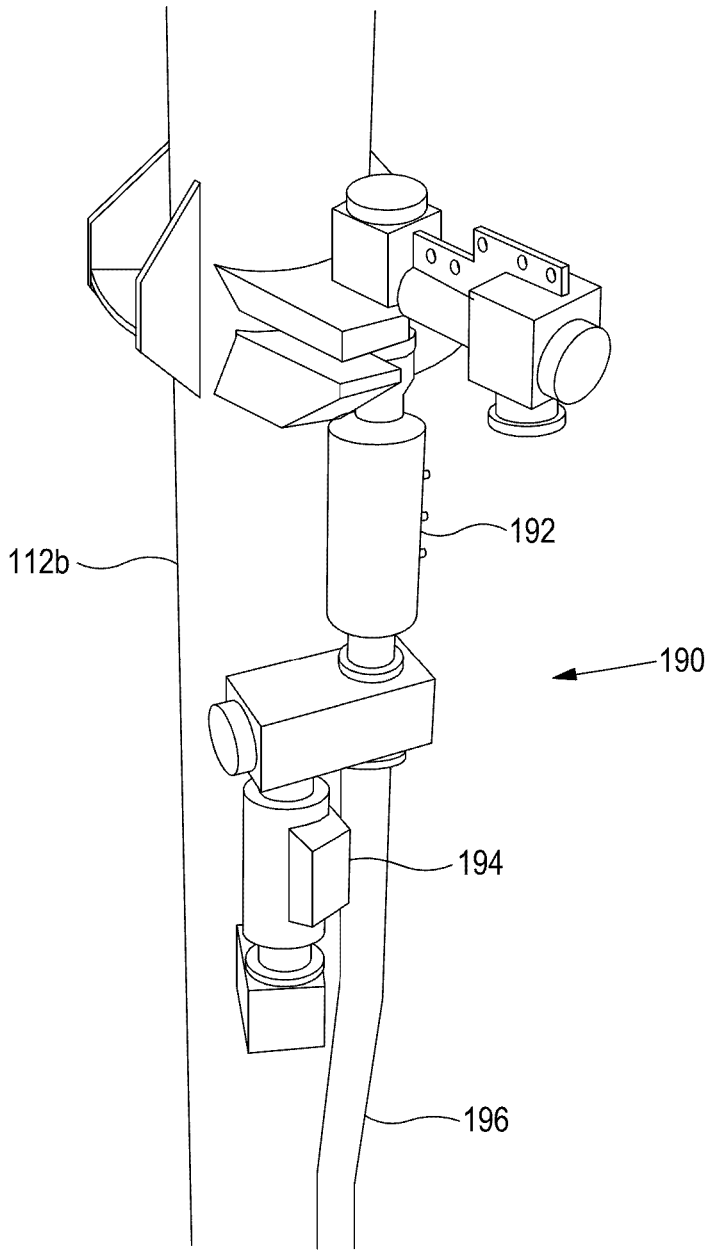

As best shown in FIG. 3D, a flow line 172 is routed from the annular body and vents into lower end of slip joint 114 outer barrel 114*a* to allow bleed and equalisation of RCD 120. FIG. 3F shows an optional booster line inlet manifold 190 with valves 192 and 194 for booster line 196 on a riser joint (or telescopic joint outer barrel). The booster line inlet manifold enables the non-intrusive pumping in 'across top' of riser column for Pressurized Mud Cap Drilling (PMCD) using existing booster pump and booster line. The booster line inlet manifold 190 enable the flushing of RCD and upper end of riser during connections. This manifold does not require an additional booster Coflexip hose (for MPD or PMCD).

Although in the above example the MPD manifold including the flow meters and choke assemblies are described as being located or mounted on an outer surface of the riser telescopic joint it will be appreciated that the MPD manifold, flow meters and/or choke assemblies may be located or mounted, located or attached to a riser joint.

Figure 4:
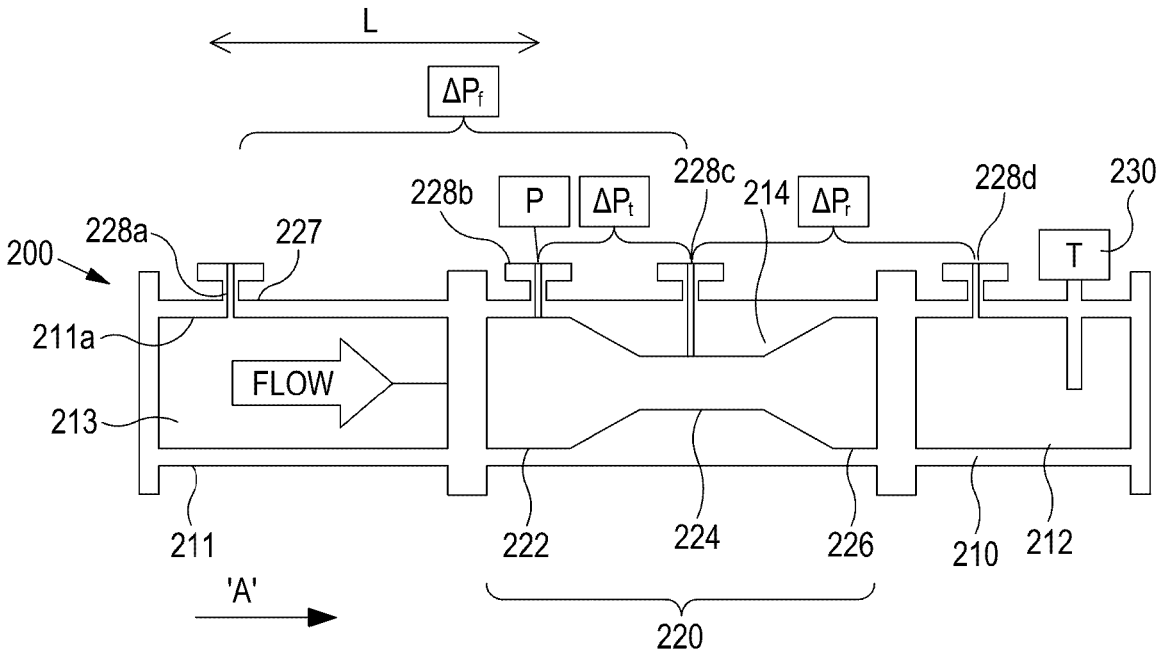
FIG. 4 is a cross-sectional schematic view of a flow meter used in the riser assembly of FIG. 2.

FIG. 4 shows a cross-sectional schematic view of an in-line flow meter for use in the MPD manifold mounted or located on the riser assembly. The flow meter is a differential pressure flow meter which is based around the use of flow adjustment members such as an obstruction or an expansion in the pipe to create a pressure drop for measurement of the volume of fluid passing through a flow meter. The flow adjustment may be created by an orifice plate, wedges, venturi, Coriolis, cones and/or a reduction in bores such as in process equipment. By measuring the differential pressure between a point immediately upstream of the obstruction/expansion and at a point downstream of the obstruction/expansion where the pressure has changed due to obstruction/expansion, the volumetric or mass flow rate can be determined.

In this example the flow meter is a venturi flow meter. However, it will be appreciated that other types of flow meter may be used.

The volumetric or mass flow rate can be derived from the differential pressure using Bernoulli's theorem which is based on the conservation of energy within a flowing fluid and a discharge coefficient. The flow meter has a reduced cross-sectional area in the flow-path of the fluid thereby creating a pressure differential on opposite sides of the flow adjustment member i.e. venturi member.

The pressure differential created on opposite sides of the flow adjustment member has a known mathematical relationship to the flow rate of the fluid passing there through, and as long as the cross-sectional area at the opening of the venturi is constant, the fluid flow measurements are very accurate.

For all differential pressure flow meter types, the density of the fluid being measured is also required to complete the calculation of mass or volumetric flow rate.

The flow adjustment member is mounted to an inner surface of the pipe for restricting the flow of fluid through the pipe and process a pressure drop in the fluid as it flows past the flow restriction member.

FIG. 4 shows a cross-sectional schematic view of flow meter 200 for use in the MPD drilling system. The flow meter 200 has a tubular housing 210 having and internal bore 212 extending longitudinally therethrough providing a fluid passageway 213 in which a flow adjustment member 214 is mounted to the inner surface 211*a* of the wall 211 of the housing 210. In this example the flow adjustment member is a venturi member 214 comprising a venturi section 220.

The venturi section 220 has an upstream section 222 which converges into a coaxial reduced diameter venturi throat section 224 which expands into a coaxial divergent downstream section 226.

The flow meter 200 has four ports 228*a*, 228*b*, 228*c* and 228*d* in the housing wall 211 which are in fluid communication with the flow through passageway 213. Port 220*a* is located in the wall 211 at a position 227 upstream of the venturi section 220, port 228*b* is located in the wall 211 of the venturi upstream section 222, port 228*c* is located in the wall 211 of the throat section and port 228*d* is located in the wall 211 of the downstream section.

The ports 228*a*, 228*b*, 228*c* and 228*d* are pressure ports for receiving a pressure sensing device to measure the pressure of the fluid flowing through the venturi which permits the detection and measurement of a pressure differential induced by fluid flow through the reduced diameter venturi throat section 224.

A temperature measurement device 230 is mounted on the housing wall 211 in fluid communication with the flow through passageway 213. In the example shown the temperature measurement device is located downstream of the venturi, but it will be appreciated that the temperature measurement device may be located upstream of the venturi. The temperature measurement device may be located in the upstream, downstream or throat section of the flow meter. The flow meter may have multiple temperature measurement devices located a different section of the flowmeter.

Temperature and/or pressure changes of the fluid being measured may cause the inner diameter of the passageway to expand or contract. Changes in the size of the inner diameter of the passageway through the flow meter can have a substantial change on the pressure drop of the fluid flowing past the venturi. This can result in inaccurate measurements.

In use, fluid flows in a direction indicated by arrow "A". Although the fluid in FIG. 4 is shown as flowing in direction "A", it will be appreciated the flow meter may also function in an opposing direction. The flow meter may be installed on a riser tubular or hose in either orientation with no effect on the operation or the accuracy of the measurement readings. The tubular body 210 has a flange 213 at either longitudinal end 210*b* of the body 210. The flanges 213 have connection means such as holes to connect the flow meter 200 to a pipeline tubulars or pipeline hoses.

The diameter of the throat section is smaller than the diameter of upstream section or downstream section, thereby restricting the fluid flow through the passageway. In use, the flow meter is connected to a hose to measure the drill fluid flow therethrough.

It will be appreciated that different flow adjustments devices may be used as an alternative to a venturi. It will also be appreciated that different restrictor shapes, sizes and configurations may be used to adjust and optimize the fluid flow meter conditions and performance.

Pressure measurements are taken at pressure ports 228*a* and 228*b* to calculate the line pressure drop due to friction ΔPf along a length L of pipe. Pressure measurements taken at pressure ports 228*b* and 228*c* enable a pressure differential ΔPt to be measured. Pressure measurements taken at pressure ports 228*c* and 228*d* enable a pressure differential ΔPr to be measured.

The quantity ΔPf/ΔPt can be subsequently calculated enabling the inline calculation of multiple properties of the flow. The pressure drop due to friction in the pipe can be expressed as equation 1 and is valid for all Reynolds numbers.

$$\Delta P_f = \frac{\lambda \rho u^2 L}{2D} \qquad \text{Equation 1}$$

where $\lambda$ is friction factor, $\rho$ is density in kg/m$^3$ $\mu$ is pipe velocity, $D$ is pipe diameter By combining Equation 1 with the Hagen-Poiseuille equation and rearranging for velocity in terms of a pressure drop it is possible to derive friction factor in laminar flow as $$\lambda = \frac{64}{\mathrm{Re}} \qquad \text{Equation 2}$$

where Re is Reynolds number

Equation 2 shows that in laminar flow, the friction factor is inversely proportional to Reynolds number only. This suggests that measuring friction factor in the laminar flow region will allow a direct calculation of Reynolds number. It follows that if the discharge coefficient is repeatable in laminar flow it can accurately be correlated with Reynolds number or indeed friction factor itself to provide inline corrections.

It is not only laminar flow where friction factor is dependent on Reynolds number. There are several well known correlations for friction factor in turbulent flows e.g. Colebrook-White equation that would perform a similar role to equation 2. In these cases the dependence on Reynolds number is not linear but the same process can be used to calculate discharge coefficient.

Friction factor and differential pressure flow measurement are important contributors to the invention.

The beta β ratio of the flow meter is the ratio of the pipe diameter to the throat diameter. The inclusion a parameter known as the Discharge Coefficient helps remove errors associated with location of pressure measurements.

Finally, a term to correct for the expansibility of the fluid c is included with c equal to 1 for incompressible fluids.

The volume flow through the flow meter venturi (in this case) is therefore $$Q = C_d \varepsilon \frac{\frac{\pi d^2}{4}}{\sqrt{(1-\beta^4)}} \sqrt{\frac{2(\Delta P_t)}{\rho}} \quad \text{Equation 3}$$

By providing a flow meter measurement system that combines the differential pressure flow rate equation (equation 3) with the friction factor equation (equation 2) allows properties of the fluid to be calculated.

The pressure measurement reading is used to measure a pressure drop, ΔPT across the differential pressure meter. Additionally, the pressure drop, ΔPf, due to friction across a straight length of pipe is measured. Using these two measurements can facilitate the calculation of various fluid properties.

By measuring the pressure drop ΔPX across the differential pressure meter and the pressure drop ΔPf along a length of pipe, and with knowledge of the pipe and meter geometry, it is possible to calculate friction factor in line using equations 4 and 5

$$\lambda = \frac{\Delta P_f}{\Delta P_1} C_M \quad \text{Equation 4}$$

Equation 4 shows two terms one a ratio of two differential pressure measurements and two a constant relating to meter geometry, pipe length and discharge coefficient.

$$C_M = \frac{D(1-\beta^4)}{C_d^2 L \beta^4} \quad \text{Equation 5}$$

Equation 5 provides a repeatable correlation for friction factor which is independent of physical properties of the fluid.

In practice, this calculation method can be accomplished by two real-time differential pressure measurements only. Low uncertainty of these measurements is subject to regular calibrations and maintenance procedures.

This can be accomplished by a calibration and characterisation of the flow meter and measurement system.

Knowledge is also required of the geometry of pipe work and flow adjustment member as well as an indication of the systems performance i.e. discharge coefficient over the useable Reynolds number range and hence friction factor range.

Characterisation and calibration allows the establishment of an equation or similar to relate discharge coefficient as a function of friction factor or to relate discharge coefficient (Cd) as a function of Reynolds number (Re).

Using the established relation between discharge coefficient with friction factor or Reynolds number with equation 4 it is possible to determine the friction factor, Reynolds number and discharge coefficient for the measurement system.

This can be achieved using an iterative approach. Alternatively, this may be achieved using calculated friction factor or Reynolds number value with the theoretical or reference value.

A simple ratio of the calculated to reference values allows for the calculation of a corrected friction factor and corrected Reynolds number as shown in equations 6 and 7 respectively. This enables the alignment or matching of measured values with calculated values.

$$\lambda_{cor} = \frac{\lambda_{the}}{\lambda_{calib}} \lambda_{calc} \quad \text{Equation 6}$$

Where $\lambda_{calib}$ is the calculated friction factor value during calibration, $\Delta_{calc}$ is calculated friction factor during operation, $\lambda_{the}$ is the theoretical friction factor for the reference Reynolds number.

$$\mathrm{Re}_{cor} = \frac{\mathrm{Re}_{ref}}{\mathrm{Re}_{calib}} \mathrm{Re}_{calc} \quad \text{Equation 7}$$

$\mathrm{Re}_{calib}$ is the calculated Reynolds number during calibration, $\mathrm{Re}_{calc}$, is the calculated Reynolds number during calibration and Reret is the reference Reynolds number during calibration.

Using the friction factor method, the correct discharge coefficient can be calculated independently of the physical properties of the drilling fluid. Equation 3 can now be used to calculate the corrected volumetric flow rate of the fluid.

Figure 5:
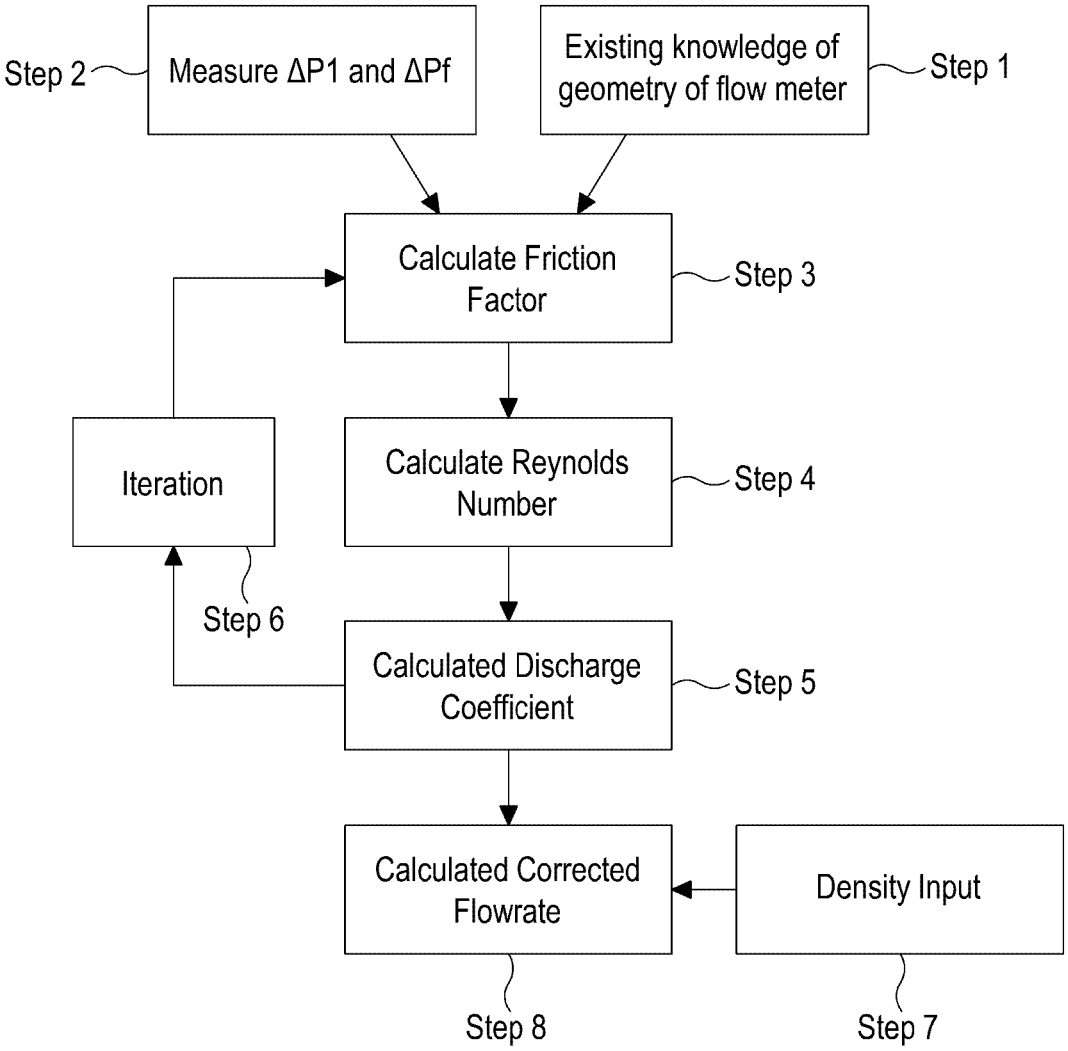
FIG. 5 is a flow diagram of the process of measuring and monitoring mud flow according to an embodiment of the invention.

FIG. 5 is a flow diagram of the process steps in determining flow properties of drilling fluid using a flow meter in accordance with an embodiment of the invention.

Referring the FIG. 5, first of all, a known relation between the discharge coefficient and the Reynolds number is obtained for the meter geometry (Step 1). Using the flow meter, the pressure differential, ΔPt across the differential pressure meter and the pressure drop APf along a length of pipe are measured (Step 2).

The friction factor is calculated using equation 4 (Step 3). In some implementations, this can involve calculating a corrected value of the friction factor as set out in equation 6.

The friction factor is used to calculate a value for the Reynolds number of the flow, for instance using equation 2. In some implementations, this can involve calculating a corrected value of the Reynolds number as set out in equation 7 (Step 4).

The discharge coefficient is calculated using the calculated or corrected value of the Reynolds number (Step 5). Step 6 shows an iterative process of calculating the value of the discharge coefficient, using the friction factor at stage 3 in some embodiments.

The density of the fluid is established by sampling, looking up tables or other appropriate method (Step 7). The established density value is used to calculate a flowrate of the fluid using equation 3 (Step 8).

If the friction factor and discharge coefficient are known then it is possible to infer the density of the drilling fluid in real-time by using equation 1. In this equation, the unknowns are density and velocity of the drilling fluid the equation may be rearranged in terms of density. The velocity may be measured using a known measurement device such as an ultrasonic meter. The measured velocity may then be used to calculate the density.

Alternatively, combining equations 1 and 3, there are two equations with two unknowns. It is possible to iterate these two values to provide a density and a corrected volumetric flowrate. This may be applicable where indications of a target density are known.

As with friction factor, correction of the density can be made on initial meter calibration by using equation 9.

$$\rho_{cor} = \frac{\rho_{ref}}{\rho_{calib}} \rho_{calc} \quad \text{Equation 9}$$

where $p_{cor}$ is the corrected density, $P_{ref}$ is the reference density during calibration, $p_{calib}$ is the calculated density during calibration and $p_{calc}$ is the calculated density during operation. When the density of the drill fluid is known, it is further possible to calculate the viscosity of the drilling fluid (μ). Knowledge of the density, pipe diameter, velocity and Reynolds number (derived from friction factor) allows viscosity to be calculated using the standard Reynolds number (Re) calculation equation as shown in equation 10.

$$\mu = \frac{\rho D u}{\mathrm{Re}} \qquad \text{Equation 10}$$

Figure 6:
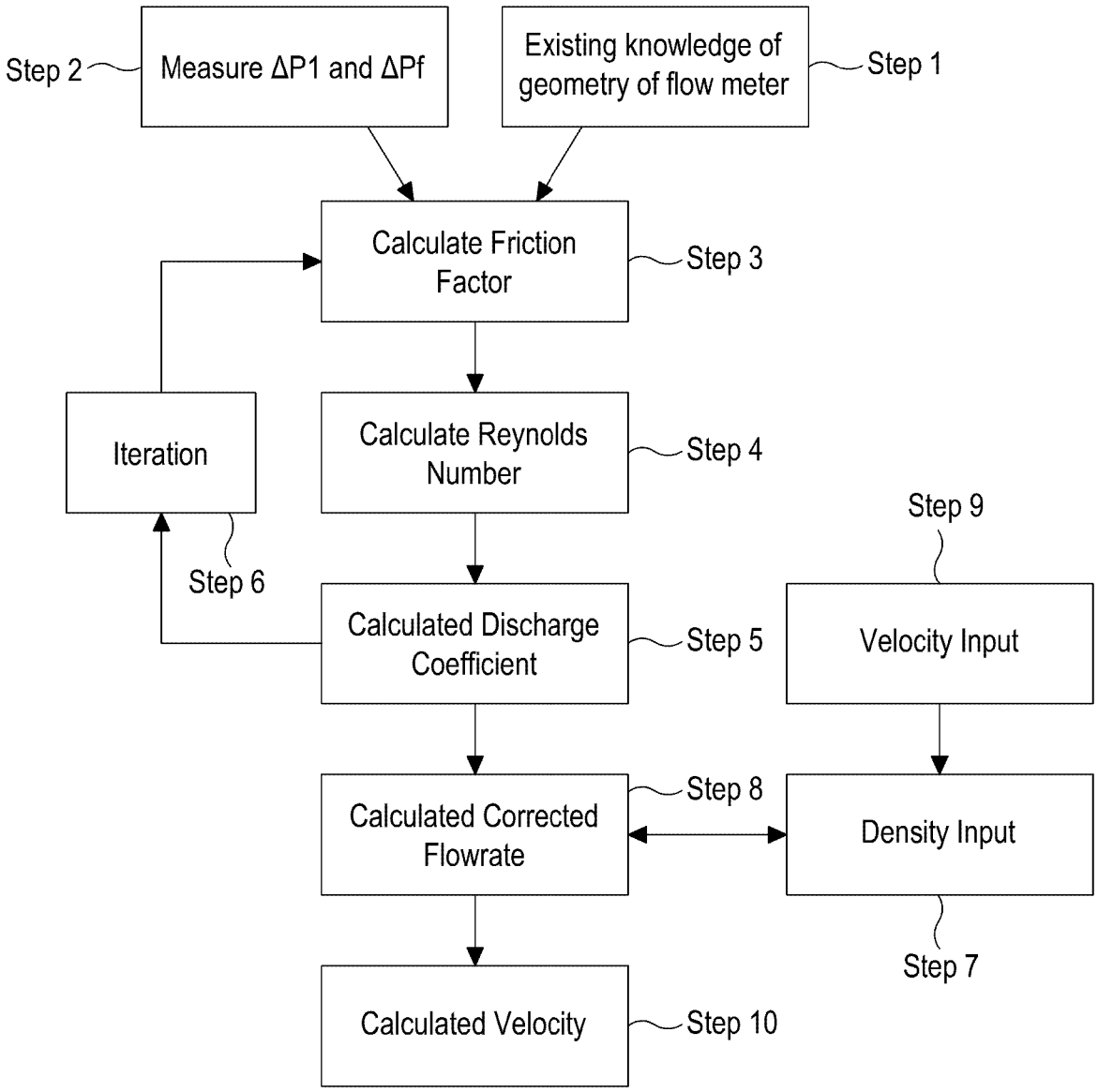
FIG. 6 is a flow diagram of the process of measuring different parameters of mud flow according to an embodiment of the invention.

FIG. 6 shows a flow diagram of the calculation of additional flow properties of drilling fluid using the above techniques is shown.

Steps 1 to 6 and 8 of FIG. 6 will be understood from the description of FIG. 5 above. However, Step 7 differs in that the density is calculated either from knowledge of a target density or from a velocity measurement using equation 1 (Step 9). In some embodiments, the value of the flowrate calculated at Step 8 may be iterated back to the calculation of the density at Step 7.

At Step 10, the viscosity is calculated using equation 10. This calculation can use a measured velocity or the velocity equivalent of the flowrate calculated at Step 8. Typically, the calculation would also use the Reynolds number calculated at Step 4 and density value at Step 7.

The knowledge of meter and pipe geometry and previous knowledge of discharge coefficient as a function of friction factor or Reynolds number, it is possible to calculate information including friction factor, Reynolds number, Discharge coefficient, density, viscosity and/or a corrected flowrate about flowing fluid from two differential pressure measurements and an indicative pipe velocity only.

The system may comprise two or more flow meters. Each flow meter may have different fluid flow range and/or fluid density range. The system may have a flow measurement range of 10 to 2000 USG/min. The system may have a switch mechanism to switch between different flow meters having different measurement ranges.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers.

Furthermore, relative terms such as", "lower", "upper, "up", "down", above, below and the like are used herein to indicate directions and locations as they apply to the appended drawings and will not be construed as limiting the invention and features thereof to particular arrangements or orientations. The term mounted may include installed in, installed on, attached to or located on a surface thereof. The terms "manifold" and "assembly" may be interchangeable.

The invention provides a well control system for a riser comprising a riser assembly and at least one flow meter, wherein the flow meter manifold is mounted on the riser.

The invention may facilitate the conversion of marine riser assemblies for MPD operations which enable conventional and/or managed pressure drilling operations.

The invention provides a complete self-contained managed pressure drilling system for connection on the riser. It avoids the requirement for MPD surface equipment and major drilling riser equipment modifications. It also mitigates the requirement for any flow return hoses from riser back to the rig/surface.

The invention mitigates the requirement for independent pipework upgrades for MPD mudflow and utilises existing rig mud return/fluid circulation system and well control procedures.

By providing a self-contained MPD system on an upper riser string and an upper riser disconnect assembly above the tension ring, components of the MPD drilling, flow meter, choke and distribution manifolds may quickly, safely and easily installed and/or removed from the riser assembly without requiring the BOP to be disconnected and the riser string pulled to surface. This configuration may allow components of a riser assembly and MPD drilling system to be installed only when they are required.

The invention enables a convention drilling riser to be converted for managed pressure drilling without requiring significant modification to rigs choke and kill and standpipe manifolds. It also avoids installing additional return hoses and numerous control lines in the moonpool or locating bulky distribution, choke and metering manifolds on the rig. The system also enables high pressure MPD returns to be diverted from beneath an RCD back into the riser (low pressure) via flow lines and the flow meter and choke assembly.

The invention provides an integrated flow spool, choke manifold and metering manifold on a retrievable riser slip joint which can be easily installed and/or removed from a riser assembly The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

The invention claimed is:

1. A well control system for a riser comprising:

a riser assembly, comprising:

an upper riser disconnect assembly located axially above a tension ring, between the tension ring and an upper end of the riser assembly;

a managed pressure drilling manifold located above the upper riser disconnect assembly and the tension ring, the managed pressure drilling manifold comprising:

at least one flow meter;

at least one choke assembly; and a flow line fluidly connected to a riser bore above the upper riser disconnect assembly, wherein the at least one flow meter and the at least one choke assembly of the managed pressure drilling manifold are mounted on an outer surface of the riser assembly and supported by the riser assembly.

2. The well control system according to claim 1 wherein the riser assembly comprises at least one valve assembly located on the riser assembly.

3. The well control system according to claim 1 wherein the riser assembly comprises a riser isolation device positioned axially between the upper riser disconnect assembly and a rotating control device.

4. The well control system according to claim 1 wherein the at least one flow meter and the at least one choke assembly are integrated with a flow spool on a riser slip joint.

5. The well control system according to claim 1 wherein the at least one flow meter is selected from the group comprising orifice plate, wedge, venturi, Coriolis, Pitot tubes, differential pressure flow meter and/or variable area flow meters.

6. The well control system according to claim 1, further comprising a control unit configured to receive at least one measurement signal from the at least one flow meter to measure at least one parameter or at least one property of drilling fluid or drilling fluid flow in the riser and/or in at least one mud return line.

7. The well control system according to claim 6 wherein the control unit is configured to monitor drilling fluid flow in the riser and/or in the least one mud return line.

8. The well control system according to claim 6 wherein the control unit is configured to calculate, estimate or predict the density and/or viscosity of the flowing drill fluid.

9. The well control system according to claim 1 wherein the at least one flow meter has a flow measurement range of 10 to 2000 USG/min.

10. The well control system according to claim 1 wherein the system comprises two or more flow meters.

11. The well control system according to claim 1, wherein the weight of the managed pressure drilling manifold is supported by the riser assembly.

12. A method of measuring at least one parameter or property of drilling fluid in a subsea riser comprising:
- providing a well control system for the subsea riser, the well control system comprising:
  - a riser assembly comprising a tension ring and an upper riser disconnect assembly located above the tension ring, between the tension ring and an upper end of the riser assembly; and
  - a managed pressure drilling manifold located above the upper riser disconnect assembly and the tension ring, the managed pressure drilling manifold comprising:
    - at least one flow meter;
    - at least one choke assembly; and
    - a flow line fluidly connected to a riser bore above the upper riser disconnect assembly,
- wherein the at least one flow meter and the at least one choke assembly of the managed pressure drilling manifold are mounted on an outer surface of the riser assembly and supported by the riser assembly; and
- measuring at least one parameter or at least one property of the drilling fluid in the riser bore.

13. The method according to claim 12 further comprising comparing the at least one parameter or at least one property of the drilling fluid with a desired range of drilling fluid operating parameters or properties.

14. The method according to claim 13, further comprising generating a control signal from a control unit when the at least one parameter or at least one property of the drilling fluid is determined to be outside of the desired range of operating parameters or properties.

15. The method according to claim 12, further comprising measuring a pressure differential across a differential pressure flow meter AP.

16. The method according to claim 12, further comprising determining or calculating a friction factor, a discharge coefficient of the flow, Reynolds number, density, viscosity and/or a flow rate of the drilling fluid.

17. The method according to claim 12, further comprising measuring at least one parameter or at least one property of the fluid using two or more flow meters.

18. The method according to claim 12, further comprising switching between a first flow meter having a first flow measurement range and a second flow meter having a second flow measurement range.

19. The method according to claim 12, wherein the weight of the managed pressure drilling manifold is supported by the riser assembly.

20. A system for managed pressure drilling in a riser comprising:
- a well control system assembly comprising:
  - a riser assembly, the riser assembly comprising:
    - an upper riser disconnect assembly located axially above a tension ring, between the tension ring and an upper end of the riser assembly; and
    - a rotating control device located above the upper riser disconnect assembly; and
  - a managed pressure drilling manifold located above the upper riser disconnect assembly and the tension ring, the managed pressure drilling manifold comprising:
    - at least one flow meter;
    - at least one choke assembly;
    - a flow line fluidly connected to a riser bore between the rotating control device and the upper riser disconnect assembly;
  - wherein the at least one flow meter and the at least one choke assembly of the managed pressure drilling manifold are mounted on an outer surface of the riser assembly and supported by the riser assembly.

21. The system according to claim 20 wherein the riser assembly comprises at least one valve assembly located on the riser assembly above the tension ring.

22. The system according to claim 20 wherein the riser assembly comprises a slip joint and the at least one flow meter is located on an outer surface of the slip joint.

23. The system according to claim 20, wherein the weight of the managed pressure drilling manifold is supported by the riser assembly.

24. A method of managed pressure drilling in a subsea drilling operation comprising:
- providing a well control system comprising:
  - a riser assembly, the riser assembly comprising:
    - an upper riser disconnect assembly located axially above a tension ring, between the tension ring and an upper end of the riser assembly; and
    - a rotating control device located axially above the upper riser disconnect assembly;
  - a managed pressure drilling manifold located above the upper riser disconnect assembly and the tension ring, the managed pressure drilling manifold comprising:
    - at least one flow meter; and
    - at least one choke assembly; and
    - a flow line fluidly connected to a riser bore between the rotating control device and the upper riser disconnect assembly;
  - wherein the at least one flow meter and the at least one choke assembly of the managed pressure drilling manifold are mounted on an outer surface of the riser assembly and supported by the riser assembly; and
- measuring at least one property of drilling fluid flow using the at least one flow meter.

25. The method according to claim 24 further comprising actuating the at least one choke assembly to control flow.

26. The method according to claim 24, further comprising diverting managed pressure drilling fluid returns from beneath the rotating control device back into the riser via the at least one flow meter.

27. The method according to claim 24, wherein the weight of the managed pressure drilling manifold is supported by the riser assembly.

* * * * *